US009994391B2

(12) United States Patent
Zhou et al.

(10) Patent No.: US 9,994,391 B2
(45) Date of Patent: Jun. 12, 2018

(54) MATERIAL FEEDING BAG

(71) Applicant: CONTEMPORARY AMPEREX TECHNOLOGY CO., LIMITED, Ningde (CN)

(72) Inventors: Zhongxin Zhou, Ningde (CN); Wutang Zhang, Ningde (CN); Taosheng Zhu, Ningde (CN); Jian Si, Ningde (CN); Zhiqiang Lin, Ningde (CN); Xie Wang, Ningde (CN)

(73) Assignee: CONTEMPORARY AMPEREX TECHNOLOGY CO., LIMITED, Ningde, Fujian Province (CN)

( * ) Notice: Subject to any disclaimer, the term of this patent is extended or adjusted under 35 U.S.C. 154(b) by 0 days. days.

(21) Appl. No.: 15/457,760

(22) Filed: Mar. 13, 2017

(65) Prior Publication Data

US 2017/0275092 A1 Sep. 28, 2017

(30) Foreign Application Priority Data

Mar. 28, 2016 (CN) ..... 2016 2 0244911 U

(51) Int. Cl.
*B65B 1/04* (2006.01)
*B65D 88/16* (2006.01)

(52) U.S. Cl.
CPC ..... *B65D 88/1618* (2013.01); *B65D 88/1681* (2013.01)

(58) Field of Classification Search
CPC ..... B65D 88/1618; B65D 88/1681
See application file for complete search history.

(56) References Cited

U.S. PATENT DOCUMENTS 3,961,655 A * 6/1976 Nattrass ..... B65D 88/1618 222/181.3

FOREIGN PATENT DOCUMENTS

CN 203682240 U 7/2014
EP 0 338 181 * 5/1988 ..... B65D 88/16

* cited by examiner

*Primary Examiner* — Jason K Niesz
(74) *Attorney, Agent, or Firm* — Morgan, Lewis & Bockius LLP

(57) ABSTRACT

The present disclosure provides a material feeding bag which comprises an inner bag. The inner bag has: an inner bag upper port portion, an inner bag main receiving portion and an inner bag lower port portion. The inner bag upper port portion has an upper port; the inner bag main receiving portion is connected to a lower end of the inner bag upper port portion along an axial direction; the inner bag lower port portion is connected to a lower end of the inner bag main receiving portion along the axial direction and has a lower port for controllable communication with an external hopper entrance. It doe not need to shear the material feeding bag by a scissors when materials is fed, so that it avoids generation of metal debris, and the mating and feeding material operation is fast and simple, and the working environment for an operator is improved.

9 Claims, 2 Drawing Sheets

MATERIAL FEEDING BAG

REFERENCE TO RELATED APPLICATIONS

The present application claims priority to Chinese patent application No. 201620244911.3, filed on Mar. 28, 2016, which is incorporated herein by reference in its entirety.

FIELD OF THE PRESENT DISCLOSURE

The present disclosure relates to a field of material processing, and specifically relates to a material feeding bag.

BACKGROUND OF THE PRESENT DISCLOSURE

Existing feeding materials (in form of powder) with a large bag requires an operator to squat down to check internal conditions of a device (related to a hopper entrance), which also needs a lighting lamp as an assistance, and then the operator puts a scissors into the interior of the device to shear off a lower sealing of the bag, after the bag is sheared, the operator needs to manually pull and open a lower port of the bag to make materials inside the bag fall down, during this process, some material powders would fall on the hands of the operator and the material powders in the bag easily erupt to the outside of the device while the bag is sheared, introduction of the scissors will easily lead to collision between the scissors and the device to generate metal debris, at the same time the material powders which stick on the hands of the operators and the lower sealing which is sheared off easily cause a secondary pollution on the working environment, the whole operation process is cumbersome in action, the operation is very difficult, also very time-consuming and low in efficiency, also easily makes a wrong operation occur, at the same time the operation needs several operators to operate simultaneously and is low in automation.

SUMMARY OF THE PRESENT DISCLOSURE

In view of the problems existing in the background, an object of the present disclosure is to provide a material feeding bag, it does not need to use a scissors to shear the material feeding bag and avoids generation of metal debris, the operation is fast and simple, and utilization rate and production efficiency of the device are improved.

Another object of the present disclosure is to provide a material feeding bag, which can improve the working environment for an operator and realizes a high efficient automation mode for automatically transporting and feeding materials.

In order to achieve the above objects, the present disclosure provides a material feeding bag which comprises an inner bag. The inner bag has: an inner bag upper port portion, an inner bag main receiving portion and an inner bag lower port portion. The inner bag upper port portion has an upper port; the inner bag main receiving portion is connected to a lower end of the inner bag upper port portion along an axial direction; the inner bag lower port portion is connected to a lower end of the inner bag main receiving portion along the axial direction and has a lower port for controllable communication with an external hopper entrance.

The present disclosure has the following beneficial effects: in the material feeding bag according to the present disclosure, the lower port of the inner bag lower port portion of the inner bag is controllably communicated with the external hopper entrance, it doe not need to shear the material feeding bag by a scissors when materials is fed, so that it avoids generation of metal debris, and the mating and feeding material operation is fast and simple, and utilization rate and production efficiency of a device related to the external hopper entrance are also improved. At the same time, during the entire feeding material process, material powder does not fall to the working environment outside the external hopper entrance, thereby improving the working environment for an operator.

Figure 1:
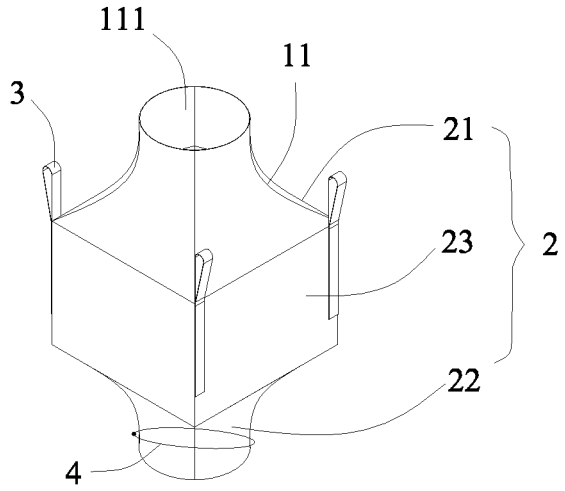
FIG. 1 is a perspective view of a material feeding bag according to the present disclosure with a strapping rope in a tight state.

Reference numerals are represented as follows:

1 inner bag
- 11 inner bag upper port portion
  - 111 upper port
- 12 inner bag main receiving portion
- 13 inner bag lower port portion
  - 131 lower port
  - 132 weak welding seal
  - 133 lower port upper portion
  - 134 lower port lower portion

2 outer bag
- 21 outer bag upper port portion
- 22 outer bag lower port portion
- 23 outer bag main receiving portion

3 hoisting lug

4 strapping rope

A hopper entrance

B pressing mechanism

DETAILED DESCRIPTION

A material feeding bag according to the present disclosure will be described in detail with reference to the figures.

Figure 2:
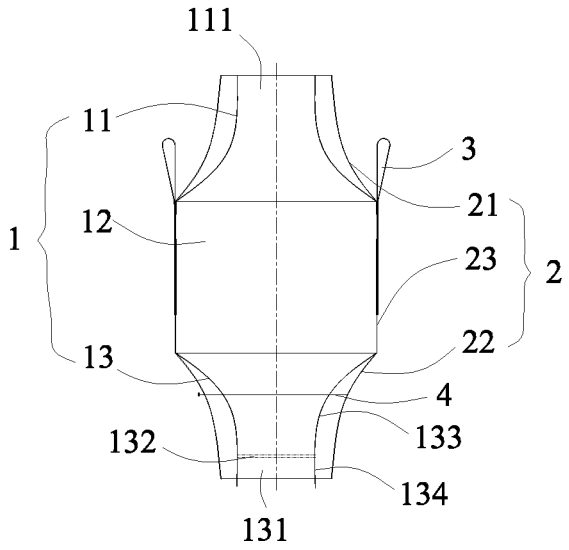
FIG. 2 is a front view of FIG. 1 with the strapping rope in a loose state.
Figure 3:
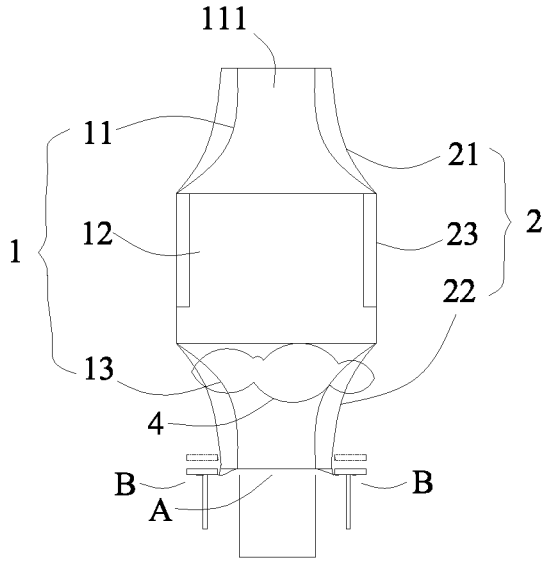
FIG. 3 is a schematic diagram with the material feeding bag mated with an external hopper entrance in the present disclosure.

Referring to FIG. 1 to FIG. 3, a material feeding bag according to the present disclosure comprises an inner bag 1. The inner bag 1 has an inner bag upper port portion 11, an inner bag main receiving portion 12 and an inner bag lower port portion 13. The inner bag upper port portion 11 has an upper port 111; the inner bag main receiving portion 12 is connected to a lower end of the inner bag upper port portion 11 along an axial direction; the inner bag lower port portion 13 is connected to a lower end of the inner bag main receiving portion 12 along the axial direction and has a lower port 131 for controllable communication with an external hopper entrance A.

In the material feeding bag according to the present disclosure, the lower port 131 of the inner bag lower port portion 13 of the inner bag 1 is controllably communicated with the external hopper entrance A, it doe not need to shear the material feeding bag by a scissors when materials is fed, so that it avoids generation of metal debris, and the entire feeding material operation is fast and simple, and utilization rate and production efficiency of a device related to the external hopper entrance A are also improved. At the same time, during the entire material feeding process, material powder does not fall to the working environment outside the external hopper entrance A, thereby improving the working environment for an operator.

In the material feeding bag according to the present disclosure, in an embodiment, referring to FIG. 1 to FIG. 3, the material feeding bag may further comprise an outer bag 2 sheathing around the inner bag 1, fixed and connected to the inner bag 1. Furthermore, the outer bag 2 has: an outer bag upper port portion 21 sheathing around the inner bag upper port portion 11; an outer bag lower port portion 22 positioned below the outer bag upper port portion 21 along the axial direction; and an outer bag main receiving portion 23 connecting the outer bag upper port portion 21 and the outer bag lower port portion 22 along the axial direction and sheathing around the inner bag main receiving portion 12. That the outer bag 2 is provided outside the inner bag 1 can avoid the inner bag 1 directly contacting the working environment so that it effectively avoids the inner bag 1 being corrosion oxidation, scratched or punctured.

In an embodiment, referring to FIG. 3, both the inner bag lower port portion 13 and the outer bag lower port portion 22 are together pressed tightly on the hopper entrance A to form a sealing between the inner bag lower port portion 13 and the outer bag lower port portion 22 and the hopper entrance A. The use of such a sealing manner after the hopper entrance A and the lower port 131 of the inner bag lower port portion 13 has been mated with the hopper entrance A can effectively prevent the material powder inside the inner bag 1 from erupting to the outside of the hopper entrance A, thus can protect the working environment and improve the working environment for the operator.

In an embodiment, referring to FIG. 3, the inner bag main receiving portion 12 and the outer bag main receiving portion 23 may be fixed together by an adhesive substance. Of course, it is not limited to this, other manners may also be used to fix and connect them.

In an embodiment, the adhesive substance may be a double-sided adhesive tape.

In an embodiment, referring to FIG. 2 and FIG. 3, the inner bag lower port portion 13 may be provided with a weak welding seal 132 which seals the inner bag lower port portion 13 (that is, weakly connects opposite parts of an inner surface of the inner bag lower port portion 13 and partitions the inner bag lower port portion 13 into a lower port upper portion 133 and a lower port lower portion 134 and which can be opened under an external force so as to make the lower port 131 open and in turn used to communicate with the external hopper entrance A.

In an embodiment, a strength of the weak welding seal 132 may be ¼~⅓ of a normal welding seal (that is, when the normal welding seal is opened under an external force, the inner bag lower port portion 13 is damaged; when the weak welding seal is opened under an external force, the inner bag lower port portion 13 is not damaged). Here it is noted that, the weak welding seal 132 may be provided as one or more streak, when every one streak of the weak welding seal 132 is added, the strength of each weak welding seal may be correspondingly reduced by ½.

In an embodiment, the weak welding seal 132 may be provided as one streak. Furthermore, a width of the weak welding seal 132 may be 6 mm~9 mm.

In an embodiment, the weak welding seal 132 may be provided as two streaks. Furthermore, the width of each weak welding seal 132 may be 3 mm~5 mm.

In an embodiment, referring to FIG. 2 and FIG. 3, an axial lower edge of the inner bag lower port portion 13 extends beyond an axial lower edge of the outer bag lower port portion 22; the weak welding seal 132 is positioned above the axial lower edge of the outer bag lower port portion 22 along the axial direction; a portion of the outer bag lower port portion 22 which is beyond the weak welding seal 132 and a portion of the inner bag lower port portion 13 which is beyond the weak welding seal 132 are pressed tightly on the external hopper entrance A by an external pressing mechanism B to form a sealing between the two portions and the external hopper entrance A after the inner bag lower port portion 13 has been mated with the external hopper entrance A.

In an embodiment, the inner bag 1 may be an aluminum-plastic film bag.

In an embodiment, the inner bag 1 may be a plastic bag.

In an embodiment, referring to FIG. 1 to FIG. 3, the material feeding bag further comprises a hoisting lug 3 provided at a position where the outer bag upper port portion 21 and the outer bag main receiving portion 23 of the outer bag 2 are connected together. Here it is noted that, by that an external transport equipment engages with the hoisting lug 3 of the material feeding bag under remote control and operation, then the material feeding bag is hoisted and transported to an appropriate position above a main material feeding station (i.e. the device related to the external hopper entrance A) by means of the hoisting lug 3, a high efficient automatic mode for automatically transporting and feeding materials is achieved.

In an embodiment, referring to FIG. 1 to FIG. 3, a strapping rope 4 may be provided around the outer bag lower port portion 22 of the outer bag 2 for achieving controllable communication of the lower port 131 of the inner bag lower port portion 13 with the external hopper entrance A.

In an embodiment, the strapping rope 4 may be a slipknot strapping rope. Based on flexibility of pulling the slipknot strapping rope, a falling speed of the materials inside the inner bag 1 may be appropriately controlled.

In an embodiment, the strapping rope 4 may be an insulating rope. Furthermore, the strapping rope 4 may be an insulating rope which can elastically elongate and contract.

Finally an operation process of the material feeding bag is explained.

One operation manner is: when the material feeding bag is hoisted and transported to a appropriate position above the main material feeding station, firstly the strapping rope 4 is pulled to the left and the right so as to loose, and next the inner bag 1 and the outer bag 2 are pulled out; then the weak welding seal 132 of the inner bag 2 is pulled open, and the lower port 131 of the inner bag 1 and the outer bag lower port portion 22 of the outer bag 2 together sheathe around the external hopper entrance A. At this time, an operator turns on the pressing mechanism B to press tightly the inner bag 1 and the outer bag 2 on the hopper entrance A to form a sealing between the inner bag 1 and the outer bag 2 and the hopper entrance A, finally, the loose and tight degree of the strapping rope 4 is manually adjusted to control a falling speed of the materials.

Another operation manner is: when material feeding bag is hoisted and transported to a appropriate position above the main material feeding station, firstly the strapping rope 4 is pulled to the left and the right so as to loose, and next the inner bag 1 and the outer bag 2 are pulled out; then the lower port 131 of the inner bag 1 and the outer bag lower port portion 22 of the outer bag 2 together sheathe around the external hopper entrance A, at this time, an operator turns on the pressing mechanism B to press tightly the inner bag 1 and the outer bag 2 on the hopper entrance A to form a sealing between the inner bag 1 and the outer bag 2 and the hopper entrance A. Finally, the weak welding seal 132 is burst open under the self-weight of the materials inside the inner bag 1, and a falling speed of the materials is controlled by controlling the loose and tight degree of the strapping rope 4.

What is claimed is:

1. A material feeding bag comprising:

an inner bag having:

an inner bag upper port portion which has an upper port; and an inner bag main receiving portion which is connected to a lower end of the inner bag upper port portion along an axial direction;

wherein the inner bag further has an inner bag lower port portion which is connected to a lower end of the inner bag main receiving portion along the axial direction and has a lower port for controllable communication with an external hopper entrance, and the inner bag lower port portion is provided with a weak welding seal which seals the inner bag lower port portion and partitions the inner bag lower port portion into a lower port upper portion and a lower port lower portion and which can be opened under an external force so as to make the lower port open and in turn used to communicate with the external hopper entrance.

2. The material feeding bag according to claim 1, wherein the material feeding bag further comprises:

an outer bag sheathing around the inner bag, fixed and connected to the inner bag, and having:

an outer bag upper port portion sheathing around the inner bag upper port portion;

an outer bag lower port portion positioned below the outer bag upper port portion along the axial direction; and an outer bag main receiving portion connecting the outer bag upper port portion and the outer bag lower port portion along the axial direction and sheathing around the inner bag main receiving portion.

3. The material feeding bag according to claim 2, wherein both of the inner bag lower port portion and the outer bag lower port portion are together pressed tightly on the external hopper entrance to form a sealing between the inner bag lower port portion and the outer bag lower port portion and the external hopper entrance.

4. The material feeding bag according to claim 3, wherein the inner bag main receiving portion and the outer bag main receiving portion are fixed together by an adhesive substance.

5. The material feeding bag according to claim 1, wherein a strength of the weak welding seal is ¼~⅓ of a normal welding seal.

6. The material feeding bag according to claim 2, wherein an axial lower edge of the inner bag lower port portion extends beyond an axial lower edge of the outer bag lower port portion;

the weak welding seal is positioned above the axially lower edge of the outer bag lower port portion along the axial direction;

a portion of the outer bag lower port portion which is beyond the weak welding seal and a portion of the inner bag lower port portion which is beyond the weak welding seal are pressed tightly on the external hopper entrance by an external pressing mechanism to form a sealing between the two portions and the external hopper entrance after the inner bag lower port portion has been mated with the external hopper entrance.

7. The material feeding bag according to claim 2, wherein the material feeding bag further comprises:

a hoisting lug provided at a position where the outer bag upper port portion and the outer bag main receiving portion of the outer bag are connected together.

8. The material feeding bag according to claim 2, wherein a strapping rope is provide around the outer bag lower port portion of the outer bag for achieving the controllable communication of the lower port of the inner bag lower port portion with the external hopper entrance.

9. The material feeding bag according to claim 8, wherein the strapping rope is a slipknot strapping rope.

* * * * *